United States Patent [19]

Draeger

[11] 4,367,790

[45] Jan. 11, 1983

[54] MULTIPLE TUBE CLEANING APPARATUS

[76] Inventor: Walter A. Draeger, 1539 Haydenview Dr., Coeur d'Alene, Id. 83814

[21] Appl. No.: 217,090

[22] Filed: Dec. 16, 1980

[51] Int. Cl.[3] ..... F28G 15/02; F28G 15/04; F28G 15/08

[52] U.S. Cl. ..... 165/95; 165/11 R

[58] Field of Search ..... 165/95, 11 R, 11 A, 165/76

[56] References Cited

U.S. PATENT DOCUMENTS

| | | | |
|---|---|---|---|
| 1,441,431 | 1/1923 | Kirgan | 165/95 |
| 1,668,577 | 5/1928 | Vecchio | 165/95 |
| 3,895,465 | 7/1975 | Korn et al. | 165/95 X |
| 4,141,754 | 2/1979 | Frauenfeld | 165/95 X |
| 4,148,403 | 4/1979 | Riffe | 165/76 X |
| 4,168,782 | 9/1979 | Sturges, Jr. | 165/76 X |
| 4,303,368 | 12/1981 | Dent et al. | 165/76 X |

FOREIGN PATENT DOCUMENTS

| | | | |
|---|---|---|---|
| 511383 | 10/1930 | Fed. Rep. of Germany | 165/95 |
| 2817992 | 8/1979 | Fed. Rep. of Germany | 165/95 |
| 160588 | 3/1921 | United Kingdom | 165/95 |

*Primary Examiner*—Sheldon J. Richter

*Attorney, Agent, or Firm*—Flehr, Hohbach, Test, Albritton & Herbert

[57] ABSTRACT

A tube cleaning apparatus especially suitable for use in a hot emission stack which includes vertical cooling tubes contained within a stacked housing is disclosed herein. This apparatus utilizes a mechanical cleaning head movable vertically between a raised position and a lowered position, a support assembly for moving the cleaning head horizontally to any desired location above the tubes and an indexing mechanism outside the emission stack for indicating the horizontal position of the cleaning head. In this way, any given tube cleaned from a remote location by first moving head to a point directly above that tube and thereafter lowering the head into and through the latter.

19 Claims, 12 Drawing Figures

MULTIPLE TUBE CLEANING APPARATUS

The present invention relates generally to tube cleaning apparatus and more particularly to a specifically designed apparatus especially suitable to cleaning the vertically extending cooling tubes contained within a vertical emission stack.

There are a number of ways presently disclosed in the prior art of cleaning tubes such as the tubes comprising part of a heat exchanger, a condenser or the like. Examples of these apparatus may be found in U.S. Pat. Nos. 1,441,431 (Kirgan); 1,668,577 (Vecchio); 2,882,022 (Greathouse, et al); and 3,123,132 (Hedgecock). In Kirgan, a condenser housing is shown containing a number of tubes opening to a waterbox or chamber. These tubes are cleaned by means of an apparatus including a spray nozzle located within the waterbox or chamber. The cleaning apparatus also provides for means including an indexing plate located outside the chamber for guiding the nozzle from one tube to another. In the Vecchio patent the heat exchanging tubes comprising part of a furnace are cleaned mechanically by means of spiral baffles which are located in the tubes and rotated manually. A mechanical tube cleaning technique is also shown in Greathouse et al where individual scrapers are located above and extend through the cooling tubes comprising part of its heat exchanger. Finally, the heat exchanger tubes in Hedgecock are cleaned by means of an apparatus which utilizes pressurized fluid, and which, to this extent, is similar to Kirgan.

As will be seen hereinafter, the present invention also provides for a tube cleaning apparatus but one which is entirely different in design than those described in the references just discussed. More specifically, as will also be seen hereinafter, the tube cleaning apparatus of the present invention is one which is especially suitable for use in cleaning the cooling tubes comprising part of a vertical emission stack, even during operation of the stack and even if the stack operates at a relatively high temperature, for example 1600° F.

In view of the foregoing, one object of the present invention is to provide an uncomplicated tube cleaning apparatus operating in a rapid but reliable manner, especially an apparatus which utilizes a mechanical cleaning head, and which requires an indexing guide or similar means for locating the cleaning head over the individual tubes, one at a time, from a remote, blind location.

Another object of the present invention is to provide a tube cleaning apparatus which can be readily moved from one group of tubes to another.

Still another object of the present invention is to provide a tube cleaning apparatus which is especially suitable for cleaning the cooling tubes comprising part of a vertical emission stack, particularly an apparatus which may be used during operation of the emission stack and even though the latter operates at relatively high temperatures.

As stated above, the tube cleaning apparatus designed in accordance with the present invention is one especially suitable for cleaning a plurality of vertically extending tubes such as those comprising part of a vertical emission stack. As will be discussed in more detail hereinafter, this apparatus utilizes a tube cleaning arrangement including a cleaning head, preferably a mechanical cleaning head vertically movable between a raised position and a lowered position. The apparatus also utilizes a cleaning arrangement support assembly including means for moving the cleaning head horizontally to locations above the tubes whereby to clean any given tube by first moving the cleaning head directly above that tube. The cleaning head is then moved into and through the underlying tube, that is, when a mechanical cleaning head is provided. In order to properly locate the cleaning head from a remote, blind location, the apparatus also includes means for indicating its horizontal location relative to the tubes.

Figure 1:
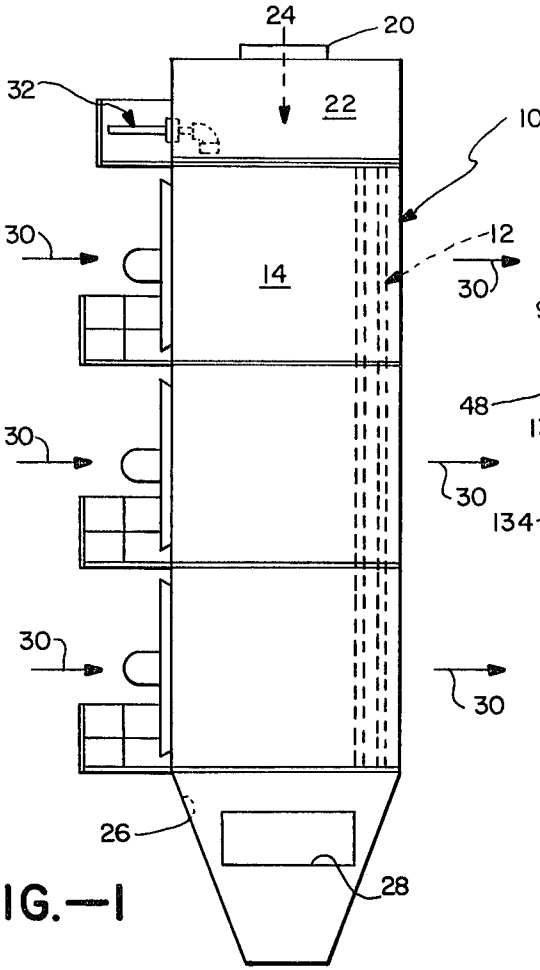
FIG. 1 is side elevational view of a vertical emission stack including a plurality of vertically extending cooling tubes contained within a stack housing.

Turning now to the drawings wherein like components are designated by like reference numerals throughout the various figures, a vertical emission stack is shown in FIG. 1 and is generally designated by the reference numeral 10. This stack may be of any conventional type which utilizes a number of individual, vertically extending emission tubes 12 (FIG. 2) contained within a stack housing 14. In the particular embodiment illustrated, the cooling tubes are supported at their top open ends by means of a horizontal support plate 16 located a predetermined distance below the top edge 18 of housing 14 and fixedly attached with the latter. With the exception of an emission inlet generally indicated at 20 in FIG. 1, the top end of housing 14 is closed. Therefore, the section of housing 14 located above support plate 16 and the plate itself together define an inlet plenum 22 for receiving emission particles through inlet 20, as generally indicated by arrows 24. The particles through the stack may be of any type including relatively high temperature particulate material such as the dust from an operating cement kiln where the dust temperature reaches levels as high as 600° F. to 800° F.

While shown only in FIG. 1 by dotted lines, emission tubes 12 may extend entirely down to the bottom of housing 14 just above its outlet plenum 26 and emission outlet 28. In this case, a lowermost tube support plate similar to plate 16 is provided just above plenum 26. On the other hand, the entire stack from its inlet end to its outlet end can be quite long. In either case, when the emission temperature is relatively high at the inlet, it may be desirable to cool down the emission particles as the latter pass through the stack. This is conventionally provided by passing ambient cooling air generally indicated by the arrows 30 through the stack housing and past the emission tubes. This requires appropriate cooling air inlets into the stack housing and outlets out of the housing which, while not shown, may be readily provided.

Figure 2:
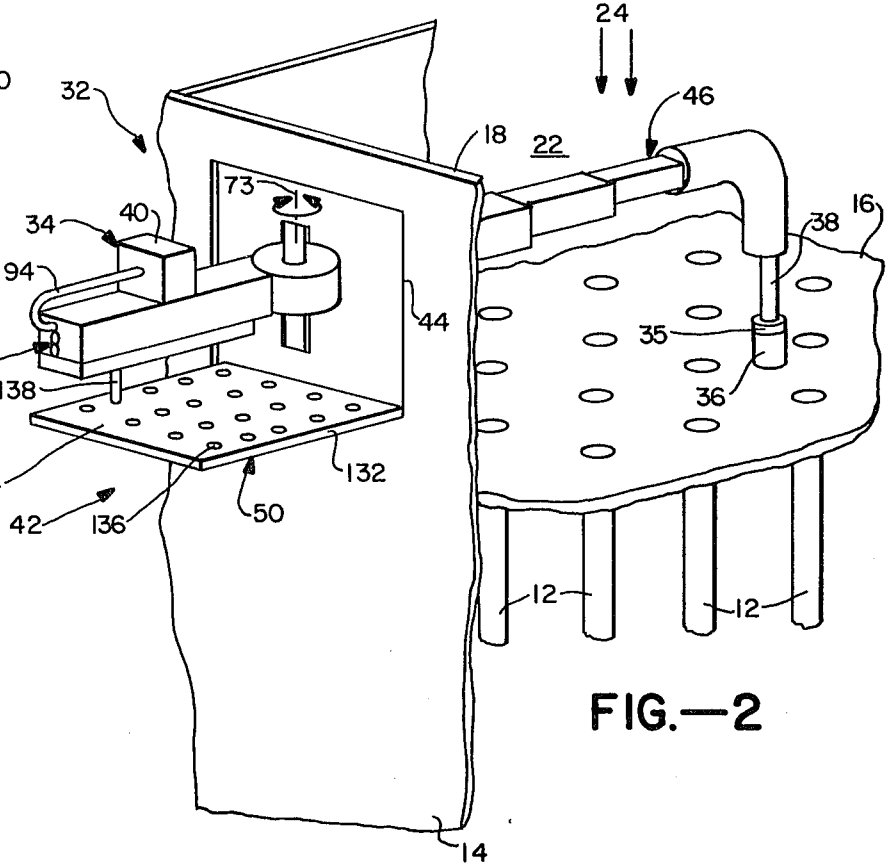
FIG. 2 is a broken away perspective view illustrating the top end section of the emission stack of FIG. 1 and an associated tube cleaning apparatus designed in accordance with the present invention.

Having described vertical emission stack 10, attention is now directed to a tube cleaning apparatus 32 which is designed in accordance with the present invention and which is especially suitable for cleaning tubes 12, particularly during operation of the stack and even though temperatures within the latter reach the high levels discussed previously. Referring specifically to FIG. 2, the tube cleaning apparatus 32 is shown including air hose drive arrangement 34 which utilizes an air motor 35 for driving a cleaning head 36 both of which are supported by means of air hose 38 for vertical movement between the raised position shown and a lowermost position (not shown) at the bottom end of an underlying emission tube. Arrangement 34 also includes a drive mechanism 40, preferably power actuated air hose reel, which operates on air hose 38 for moving cleaning head 36 between its raised and lowered positions. While not shown, a suitable supply of air is provided through hose 38 for air motor 35. The air hose drive mechanism 40 in and by itself is conventional and may be readily provided for use as part of tube cleaning apparatus 34. The particular way in which this arrangement is supported relative to emission tubes 12 and rest of stack 10 will be discussed hereinafter. For the moment, it should suffice to say that only the cleaning head itself, the air motor and hose 38 are located within inlet plenum 22 and hence only these components are subjected to the rather hostile environment of the plenum. The drive mechanism 40 which, of all the components making up the tube cleaning arrangement, would be most susceptible to damage as a result of such an environment, is at all times maintained outside the stack in the relatively mild ambient surroundings.

Tube cleaning apparatus 32 also includes a cleaning arrangement support assembly 42 located partially within stack housing 14 in plenum 22 and partially outside the housing. In this regard, the housing itself is provided with a suitably sized opening 44 located a predetermined distance above tube support plate 16. As will be discussed in more detail hereinafter, assembly 42 includes an extension tube mechanism 46 partially located within inlet plenum 22 and designed to support cleaning head 36 and its associated motor and hose for horizontal movement above emission tubes 12 when the cleaning head is in its raised position. In this way, any given tube may be cleaned by first moving the cleaning head to a point directly above that tube and thereafter lowering cleaning head into and through the latter while the head is simultaneously rotated about its own vertical axis. Support assembly 42 also includes a tube extension drive mechanism 48 connected with mechanism 46 and partially located outside the stack housing for providing the horizontal movement of mechanism 46 just described from outside the housing. In addition to support mechanism 46 and tube extension drive mechanism 48, the overall support assembly includes a mechanism 50 which is also positioned outside the stack housing and which is connected with support mechanism 46 for indicating the horizontal location of the cleaning head relative to tubes 12, thereby serving as an indexing guide. This is of course quite important since it is not always practical or even possible to view either directly or indirectly the position of the cleaning head relative to the tubes.

Figure 10:
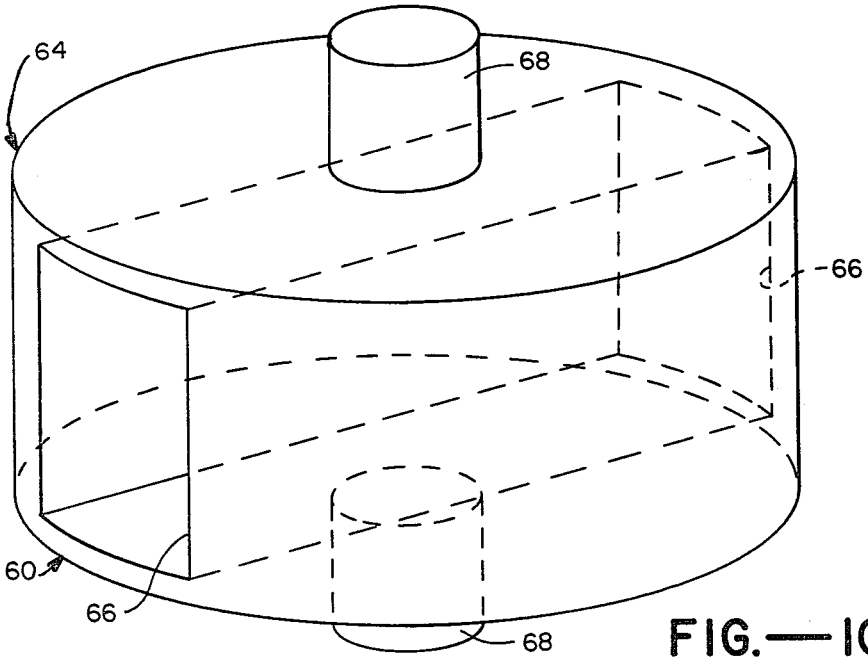
FIG. 10 is an enlarged perspective view of yet another aspect of tube cleaning apparatus of FIG. 4, specifically of pivoting support drum comprising part of the apparatus.

Referring now to FIGS. 4 to 7, attention is specifically directed to mechanism 46 comprising part of the overall support assembly 42 discussed above. The primary components making up this mechanism are four elongated tubes 52, 54, 56 and 58, a support drum 60 and a cleaning head connection 62. The support drum which is best seen in FIG. 10 includes a hollow cylindrical housing 64 including diametrically opposite openings 66 and coaxial top and bottom bearing pins 68. Returning to FIG. 4, the two bearing pins are disposed within two vertically aligned pillow block bearings 70 welded or otherwise fixedly attached to a closure plate 72 which also comprises part of the overall support mechanism 46. This closure plate is disengagable connected by clamps or other suitable means (not shown) to stack housing 14 across previously described opening 44 in the position shown in FIG. 4 and is sufficiently large to close this latter opening. The closure plate includes its own opening between the two pillow block bearings for receiving the cylindrical body 64 of drum 60 when bearing pins 68 are disposed within their respective pillow block bearings. Moreover, this latter opening is sufficiently large to allow the drum body to rotate freely about its axis generally indicated at 73.

Figure 4:
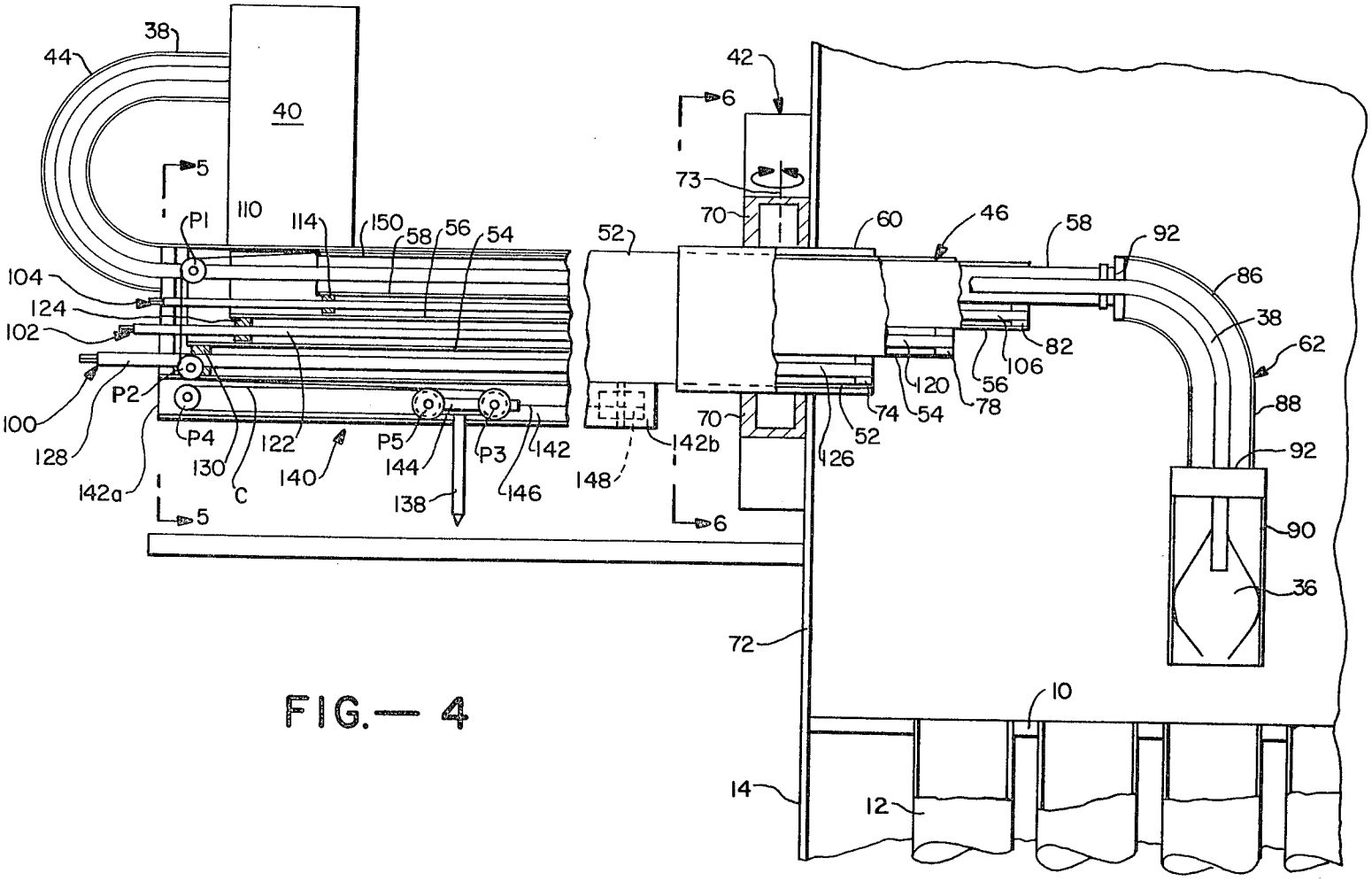
FIG. 4 is an enlarged, partially broken away side elevational view of the tube cleaning apparatus of FIGS. 2 and 3, specifically illustrating the apparatus in an operating position.
Figure 6:
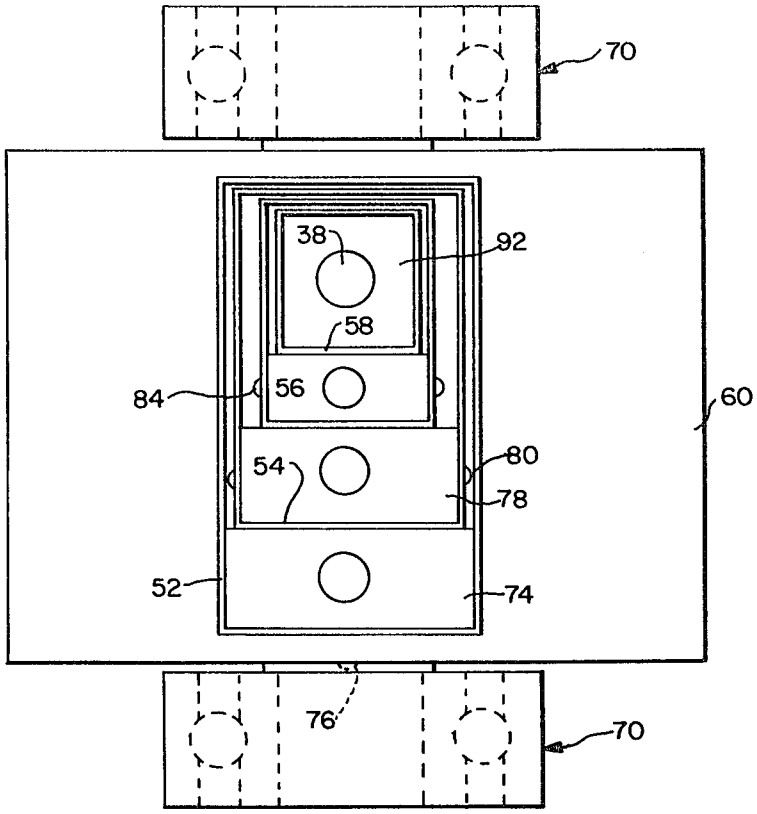
FIG. 6 is a vertical sectional view of the tube cleaning apparatus of FIG. 3 taken generally along line 6—6 in FIG. 4.
Figure 5:
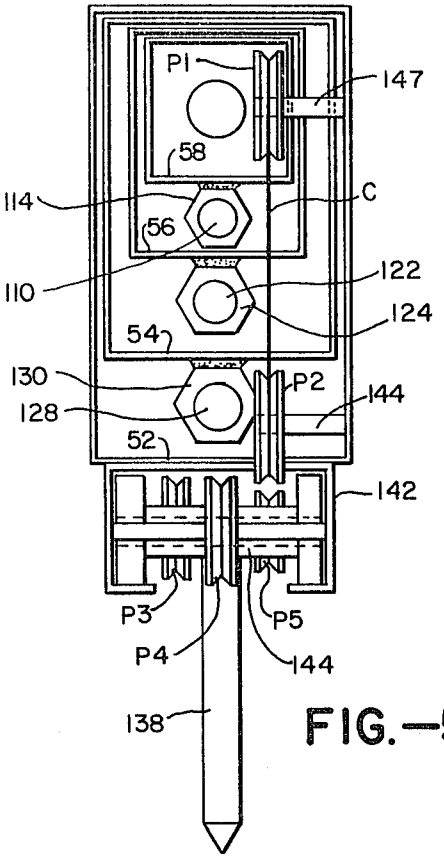
FIG. 5 is a vertical sectional view of the tube cleaning apparatus of FIG. 4, taken generally along the line 5—5 in FIG. 4.

Having described support drum 60, attention is now directed to the four previously mentioned tubes, each of which is rectangular in cross-sectional configuration as best seen in FIGS. 5 and 6. The first of these tubes, that is, tube 52, is the largest in cross section, as also seen in FIGS. 5 and 6 and includes a front end section 52*a* (FIG. 7) located within drum body 64 through one of its openings 66. The front end section 52*a* is fixedly held in place within the drum body by means of a bearing block 74 and cooperating cap screw 76. More specifically, the bearing block which is rectangular in cross-sectional configuration as best seen in FIG. 4 is located at the bottom forwardmost corner of tube section 52*a* and extends the width of the latter. The cap screw 76 fastens into the bearing block through drum body 64 and tube section 52*a* for maintaining the latter fixed relative to the support drum. In this way, elongated tube 52 is pivotally movable about vertical axis 73 along with the support drum but otherwise remains fixed. As will become apparent hereinafter, this linearly fixed but rotatably movable tube serves as an outermost support frame for many of the components making up support mechanism 46 as well as other components comprising part of the overall tube cleaning apparatus.

The second elongated tube mentioned previously is tube 54 which is slightly smaller in cross-sectional configuration than tube 52, as best seen in FIGS. 5 and 6. In fact, as seen in these latter figures, the width (horizontal dimension) of tube 54 is only slightly less than the width (horizontal dimension) of tube 52. However, the height (vertical dimension) of tube 54 is significantly less than the height (vertical dimension) of tube 52, specifically by an amount approximately equal to the height of previously described bearing block 74. Returning to FIG. 7 in conjunction with FIGS. 5 and 6, it can be seen that tube 54 is slidably mounted within tube 52 entirely through support drum body 64 through diametrically opposite openings 66. The front end of tube 54 is supported by and slides on the top surface of bearing block 74. Moreover, tube 54 includes its own bearing block 78 which is also rectangular in cross-sectional configuration. Bearing block 78 is located at the bottom front end of tube 54 and is fixedly held in place by means of cap screws 80 extending into the block from opposite sides of the tube.

The remaining previously described elongated tubes, that is, tubes 56 and 58 are mounted relative to one another and to tube 54 in the manner described with respect to tubes 52 and 54. More specifically, tube 56 is located within tube 54 for slidable movement on bearing block 78 and includes its own rectangular bearing block 82 fixedly located at its front bottom end by means of cap screws 84 extending into the ends of the bearing blocks from opposite sides of the tube. Elongated tube 58 is slidably mounted within tube 56 on bearing block 82. However, since tube 56 is the last or innermost one of the tubes, it does not include its own bearing block.

As will be seen hereinafter, all of the tubes described above with the exception of outermost tube 52 are interconnected at their rearward ends with tube extension drive mechanism 48 for telescopically moving the three inner tubes between extended positions and retracted positions such that the forwardmost end of the innermost tube, that is, tube 58 move between an outermost extended position and an innermost retracted position. As will be seen below, cleaning head 36 is supported at the forward end of tube 58 for similar linear movement. At the same time, all of the tubes and particularly the forwardmost end of tube 58 and the cleaning head are supported for pivotal movement about vertical axis 73 by means of support drum 60, thereby providing the previously described overall horizontal movement of the cleaning head. In addition to the foregoing, support mechanism 46 includes connection 62 for cleaning head 36, as stated previously. As seen best in FIG. 4, this connection includes a 90° elbow 86 fixedly connected at its top end to the forwardmost end of inner tube 58 by suitable means and extending outwardly and downwardly thereform. The lower end of elbow 86 is connected to one end of a vertically extending straight connecting section 88 which, in turn, is connected at its bottom end to the top of a cylindrical guide 90 opened at its bottom end and containing motor 35 and head 36 when the latter is in its raised position. It should be apparent from FIG. 4 that the forwardmost section of hose 38 extends through and is supported by the three sections of support 62, that is, elbow 86, straight section 88 and cylindrical guide 90. Suitable guide flanges comprising part of or otherwise located at the ends of these sections and generally indicated at 92 are provided for maintaining the contained section of the drive cable concentrically within connection 62. It should be equally apparent from FIG. 4 that the remaining section of the hose extends back through inner tube 58 to the back end of the latter where it exits the inner tube and joins drive mechanism 40. The rotary drive mechanism itself is supported by and is movable with outermost tube 52 as the back end of the latter. A 180° elbow section 94 connected at one end to the upper back end of outermost tube 52 and its other end to rotary drive mechanism 40 is provided for containing the rearwardmost end of drive cable 38. A centering flange 92 is provided for centering the drive cable as the latter enters the connecting elbow from tube 58.

Having described support mechanism 46 comprising part of the overall cleaning arrangement support assembly 42, attention is now directed to tube extension drive mechanism 48. As stated above, the purpose of this tube extension drive mechanism is to provide the previously described horizontal movement of cleaning head 36 when the latter is in its raised position. This is accomplished by telescopically moving the three tubes 54, 56 and 58 linearly between their retracted and extended positions while simultaneously pivoting all of the tubes about vertical axis 73. As will be seen below, the linear telescoping component of this horizontal movement is provided by first moving the innermost tube 58 to a predesired extended position. If a greater distance of movement is required than is available by tube 58, tube 56 is then linearly extended out from tube 54 and, finally, if still more distance is required tube 54 is linearly extended out from tube 52. The maximum distance of linear movement available is provided by moving all three tubes to their maximum extended positions.

Figure 7:
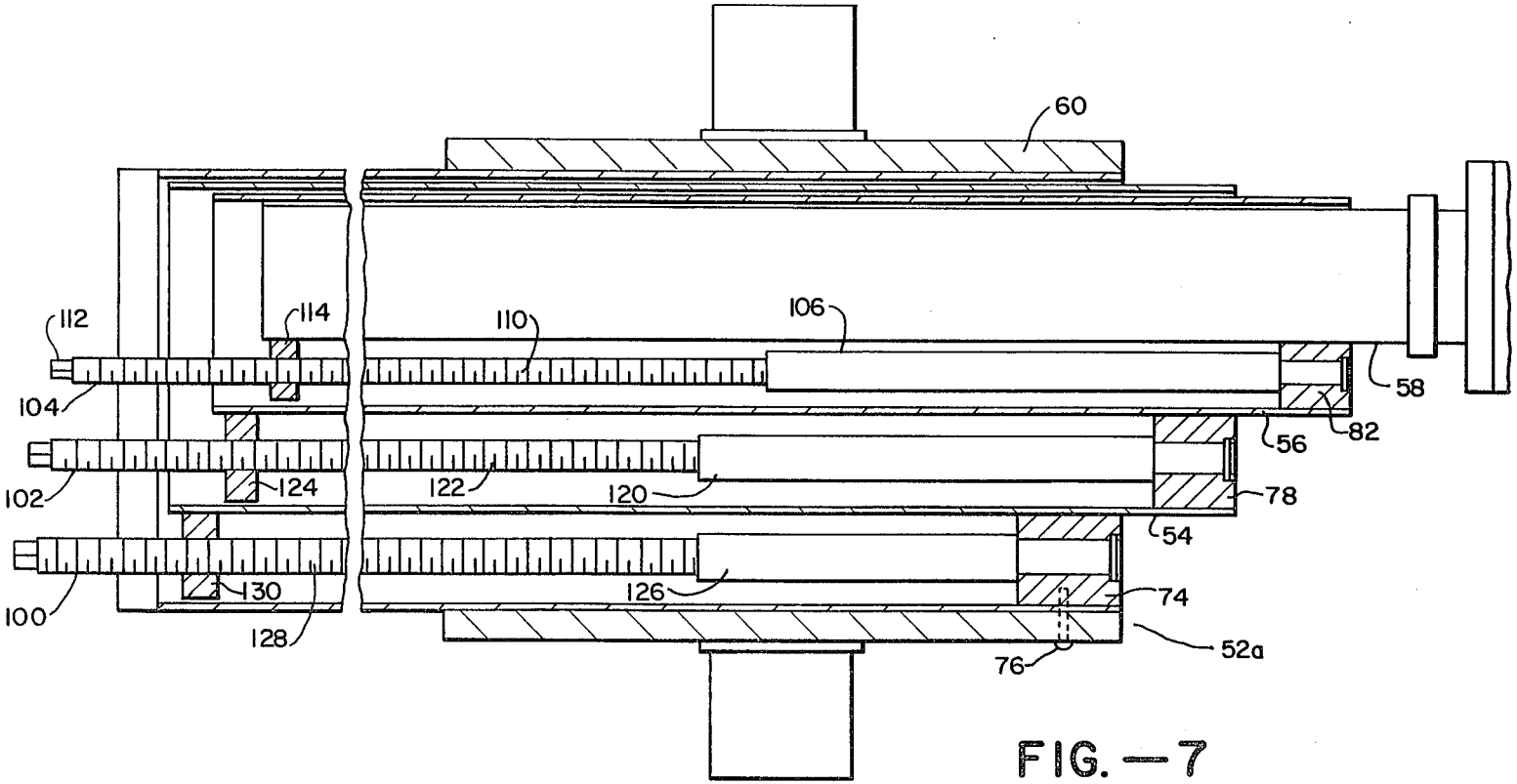
FIG. 7 is an enlarged, partially broken away side elevational view of a portion of the tube cleaning apparatus of FIG. 4, particularly illustrating certain aspects of the apparatus.
Figure 9:
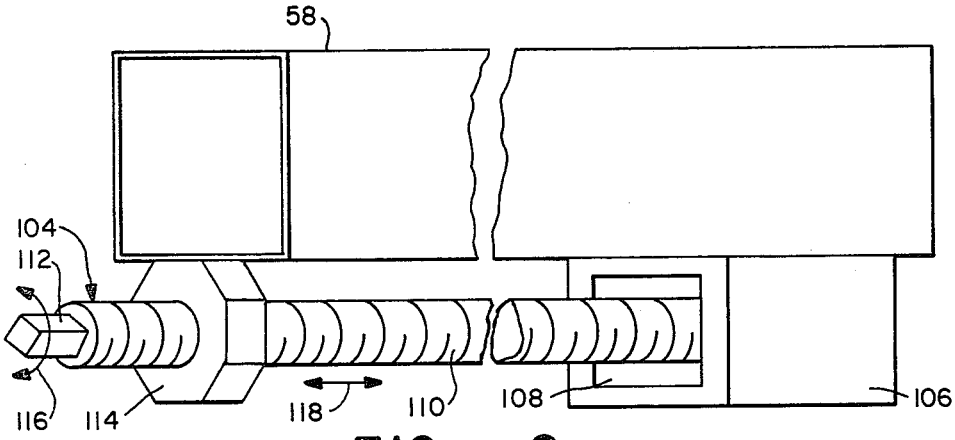
FIG. 9 is an enlarged, partially broken away side elevational view of still another particular aspect of the tube cleaning apparatus of FIG. 4, specifically of a drive rod arrangement comprising part of the apparatus.

In order to provide the linear movement just described, tube extension drive mechanism 48 includes three tube driving devices 100, 102 and 104 respectively associated with tubes 54, 56 and 58. Device 104 is best shown in FIG. 9 in conjunction with FIGS. 6 and 7. From these figures, it can be seen that the overall device includes a connecting tube 106 extending through tube 56 just under innermost tube 58, as best seen in FIG. 7. As also seen best in this latter figure, the forwardmost end of connecting tube 106 is fixedly attached to the backside of bearing block 82.

As seen best in FIG. 9, the otherwise free end of connecting tube 106, that is, its rearwardmost end, contains an annular bearing 108 fixedly located therein. This bearing is provided for receiving the forwardmost end of an Acme thread rod 110 which also comprises part of the overall tube driving device 104. The otherwise free end of the Acme thread rod, that is, its rearwardmost end, carries a suitable gripping member 112 adapted to cooperate with a power drill, a hand held tool or other such means for rotating the rod about its own axis. The annular bearing 108 is of course provided for supporting the rod to allow this rotational movement and prohibit longitudinal movement of the Acme thread rod.

As seen best in FIG. 9, Acme thread rod 110 carries a cooperating threaded nut 114 which is movable along the Acme thread rod in the direction toward the connecting tube when the Acme thread rod is rotated in one direction, and in a direction away from the connecting tube when the Acme thread rod is rotated in the opposite direction, as generally indicated by the two-way arrows 116 and 118. In this regard, it should be noted that the threaded nut is fixedly connected at its top side to the underside of innermost tube 58 at the back end of the latter. Accordingly, when the Acme thread rod is rotated to move the nut towards connecting tube 106, the innermost tube 58 moves in the same direction a distance equal to that of the nut. In the embodiment shown, the nut may move between a rearwardmost position adjacent the back end of rod 110 to a forwardmost position just in front of annular bearing 108.

From the foregoing, it should be apparent that innermost tube 58 can be moved between its completely retracted position and fully extended position merely by rotating Acme thread rod 110 in the appropriate direction. This is equally true of tubes 54 and 56 using tube driving devices 100 and 102 which except possibly for length may be identical to device 104. More specifically, device 102 includes a similar connecting tube 120 and interconnected Acme thread rod 122 as seen best in FIG. 7 as well as a similar threaded nut 124 (FIG. 5). In a similar manner, device 100 includes a connecting tube 126 and associated Acme threaded rod 128 as shown in FIG. 7 and a threaded nut 130 as best seen in FIG. 5. The forwardmost ends of connecting tubes 120 and 126 are respectively fixedly connected to bearing blocks 78 and 74 while their other ends carry annular bearings similar to bearing 108. As seen in FIG. 5, threaded nut 124 is welded or otherwise fixedly connected to the underside of tube 56 at the rear end of the latter and threaded nut 130 is welded or otherwise fixedly connected to the underside of tube 54 at the rear end of that tube. Each of these latter tubes is moved between its retracted and extended positions in the same manner as tube 58. However, the linear movement of tube 56 causes similar additional movement of tube 58 and linear movement of tube 54 causes similar additional movement of both tubes 56 and 58. This is because these three tubes are interconnected together by drive rod devices 102 and 104. In this regard, it should be apparent that the drive rod device 104 moves linearly with tube 56 and device 102 moves linearly with tube 54.

At this point, it is worthy to note that there is a preferred sequence of linear movement of the three tubes 54, 56 and 58 relative to fixed outermost tube 52. More specifically, assuming that the linearly movable tubes are all in their retracted positions, the innermost tube 58 is the first one to be moved towards or to its extended position. If cleaning head 36 needs to be moved a greater distance linearly, the next adjacent tube, that is, tube 56 is moved from its retracted position towards or to its extended position. Finally, if still a greater linear distance is required for the cleaning head, the next adjacent tube, that is tube 54, is moved towards or to its extended position. From the foregoing, it should be apparent that when the second tube 56 is moved from its retracted position it carries with it tube driving device 104 since the connecting tube 106 of this device is fixedly connected at its forwardmost end to bearing block 82. In a similar manner, when tube 54 moves from its retracted position the tube driving device 102 is carried with it. Both of these latter devices become inaccessible to the operator when their connected tubes move to their fully extended positions, unless of course their Acme rods are made sufficiently long to be made fully accessible at all times. In most cases, this is not practical. As a result of the inaccessibility of devices 102 and 104 when tubes 54 and 56 are in their fully extended positions, the sequence of movement bringing the tubes back to their retracted position is opposite to that described above. More specically, the tube 54 is brought back to its retracted position first and then the tube 56 and finally tube 58. In this way, tube driving device 122 becomes accessible when tube 54 is brought back to its retracted position by tube driving device 100 which always remains accessible since the outermost tube 52 does not move linearly. Once tube driving device 102 becomes accessible it can be used to bring back tube 56 making tube driving device 104 accessible for bringing back innermost tube 58.

From the foregoing, it should be apparent that the total movement of innermost tube 58 is equal to the combined movement of all three threaded nuts 114, 124 and 130. By the same token, the total movement of tube 56 is equal to the combined movement of nuts 124 and 130. In accordance with one aspect of the present invention, the length of each of the tubes 52, 54, 56 and 58 are selected with a particular end result in mind. More specifically, when the movable tubes are all in their extended positions, the overlaps between tubes are successively greater starting with the outermost tubes. In other words, with the tubes in their fully extended positions, the overlap between the tubes 54 and 56 is greater than the overlap between the tubes 52 and 54. At the same time, the overlap between tubes 56 and 58 is greater than the overlap between the tubes 54 and 56. This lends greater structural integrity to the overall support mechanism 46 during operation of the latter.

Another aspect of the present invention relating to support mechanism 46 resides in the utilization of previously described bearing blocks 74, 78 and 82. As stated previously, these bearing blocks extend the entire width of their respective tubes. As a result, each bearing block not only serves to provide a bearing surface for the next adjacent tube above it and as means for connecting an associated connector tube but it also serves to block any excessive amounts of air within plenum 22 from passing between the adjacent tubes and escaping into the ambient surroundings along with foreign particles which might otherwise pollute the immediate surroundings.

Thus far, tube extension drive mechanism 48 has been described with respect to the way in which it moves cleaning head 36 linearly by extending and retracting three of the four tubes making up support mechanism 46. It should be apparent however, that the tube extension drive mechanism which includes the three tube driving devices 100, 102 and 104 can be used as a gripping means for pivoting all of the tubes and support drum 60 about vertical axis 73. However, as a practical matter, the rearward end of outermost housing 52 would typically be used for pivoting the tubes and support drum and to this extent may be considered part of the overall tube extension mechanism 48. In any event, it should be apparent that by combining the linear movement described above with this pivotal movement, the cleaning head 36 can be readily moved to any position over tube support plate 16 for locating the cleaning head over a given one of the tubes 12.

Having described support mechanism 46 and tube extension drive mechanism 48 making part of overall cleaning arrangement support assembly 42, attention is now directed to guide mechanism 50 also comprising part of the support assembly. As will be seen below, this latter mechanism is connected with mechanism 46 for indicating the horizontal location of the cleaning head 36 relative to tubes 12 and hence serves as an indexing guide in locating the cleaning head above the tubes. As will also be seen, the entire guide mechanism is located outside emission stack 10 and therefore is not subject to the hostile environment therein.

Figure 3:
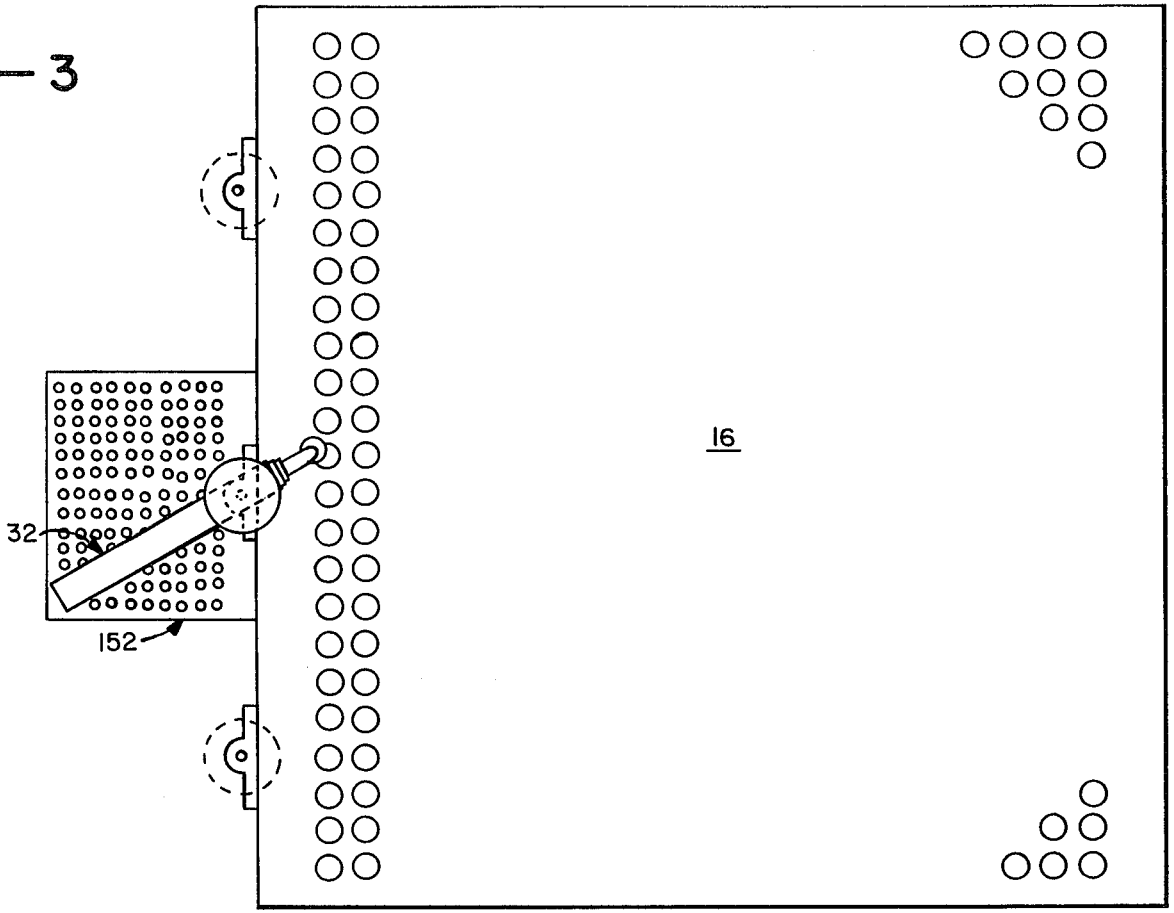
FIG. 3 is a top plan view of the stack and tube cleaning apparatus.

Referring specifically to FIGS. 2 and 3 in conjunction with FIG. 4, mechanism 50 is shown including and indexing plate 132 located directly under the back end of outermost tube 52 comprising part of mechanism 46. The indexing plate is fixedly attached to previously described closure plate 72 by suitable means (not shown) and includes a horizontally extending, planar top surface 134 carrying indicia generally indicated at 136 which represents the relative positions of tubes 12 but scaled down to fit within the confines of the plate.

In a preferred embodiment, the indicia on plate 132 are scaled down by a factor of four which means that the distance between any two given tubes within the stack housing is four times the distance between corresponding indicia on plate 132. In addition, as will be seen below, the positional relationship of the indicia is different than the positional relationship of the actual tubes relative to opening 44 and closure plate 72. More specifically, where for example a given tube lies in the top left hand corner of plenum 22 as viewed in FIG. 3, the indicia of that tube on surface 134 of plate 132 appears on the bottom right hand corner of the plate as viewed in the same figure. The reason for this difference in positional relationship will become apparent hereinafter.

Figure 8:
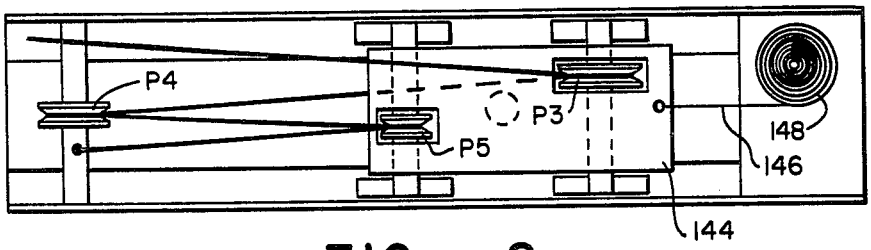
FIG. 8 is an enlarged, bottom plan view of a portion of the tube cleaning apparatus of FIG. 4, illustrating another aspect of the latter.

In addition to indexing plate 132, guide mechanism 50 includes a vertically extending guide pin 138 and a carriage arrangement 140 interconnecting the guide pin with support mechanism 46 such that the guide pin moves across indicia 136 along with and as a result of the movement of cleaning head 36 in a way which indicates the location of the cleaning head on the guide plate. In order to accomplish this, arrangement 140 includes an elongated channel 142 extending along and fixedly connected with the underside of outermost tube 52 between the rearward end of the tube as indicated at **142*a* and a point just outside support drum 60, as indicated at 142*b* (see FIG. 4). This channel serves as a two-sided track (see FIG. 5) for carrying a carriage 144 for movement along its length. This carriage in turn carries guide pin 138 for horizontal movement across plate 132. The carriage is biased in its forwardmost position, that is, a position adjacent forwardmost end 142*a* adjacent support drum 60 by means of a tension cable 146 comprising part of a biasing spring 148 which is fixedly mounted to the underside of outermost tube 52 adjacent channel end 142*b*, as best seen in FIG. 8. The carriage and guide pin are maintained in this position when all the linearly movable tubes comprising part of support mechanism 46 are in their completely retracted positions which means that the cleaning head is in a similar retracted position. As will be seen, the movement of the carriage and guide pin relative to guide plate 132 includes two components, a linear component and a pivotal component about axis 73**, as does the cleaning head itself.

As stated above, the overall movement of carriage 144 and guide pin 138 includes a linear component and a pivotal component. The linear component of movement is accomplished by means of a pulley system including six pulleys, P1 to P5, and a single continuous cable C. As seen best in FIG. 5, the pulleys P1 and P2 are fixedly connected to the outermost tube 58 at the back end of the latter (FIG. 4) by means of shafts 147 and 149. Pulleys P3 and P5 are both located on carriage 144 with pulley P3 being positioned in front of pulley P5, as best seen in FIG. 8. Finally, pulley P4 is fixedly located to and at the back end of channel 142 just below pulley P2. Cable C is fixedly connected at one end to and movable with innermost tube 58 at the back end of this tube as indicated at 150 in FIG. 4. The cable extends from this point vertically downward behind and against pulleys P1 and P2 and thereafter in a forward, horizontal direction around the forward side of pulley P3 and back to and around the backside of pulley P4. From pulley P4, the cable extends in the forward direction again around pulley P5 and back to pulley P4 where it is fixedly attached at its otherwise free end to the axle of this latter pulley.

In view of the foregoing, it should be apparent that carriage 144 remains in its biased position adjacent the forwardmost end of plate 132 (near end **142*a* of channel 142) when the linearly movable tubes 54, 56 and 58 are in their complete retracted positions. As the innermost tube 58 moves out from this position in a forward direction, it should be apparent that the top end of cable C is moved in the same direction causing the carriage and connected guide pin 138 to move in a rearward direction a proportionate distance which depends upon the positional relationships of the various pulleys. In a preferred embodiment, the free end of the innermost tube and hence cleaning head move linearly forward four times as far as rearward linear movement of the carriage and guide pin. Obviously, this ratio could be varied by those with ordinary skill in the art by redesigning the pulley system. Moreover, it should also be obvious that the pulley system must be compatible with the indicia on plate 132 so as to accurately indicate the position of cleaning head 36** as a result of its linear movement. This too may be readily provided by those with ordinary skill in the art.

The pivotal component of movement of carriage 144 and guide pin 138 is provided merely by the fact that channel 142 which supports the carriage and guide pin, pivots with outermost tube 52 carrying the carriage and guide pin with it. In this regard, it should be apparent that the pivotal movement of the carriage and guide pin about axis 73 is in a direction opposite to that of the cleaning head since it is on the opposite side of the axis. Moreover, the amount of pivotal movement of the carriage and guide pin is proportionate to the pivotal movement of the cleaning head but scaled down since it is closer to the vertical axis than the cleaning head. Like the linear component, the ratio of pivotal movement between the guide pin and cleaning head can be readily selected and must be selected in light of the guide plate 132 so as to provide an accurate indication as to the position of the cleaning head.

Another aspect of the aspect of the present invention resides in the foregoing configuration for moving guide pin 138 with cleaning head 36. More specifically, as noted above, forward movement of the cleaning head causes the guide pin to move a proportionate distance rearwardly. Therefore, the distance between the cleaning head and the guide pin is greater than would be the case if the guide pin moved in the same direction as the cleaning head. For example, assume a ratio of linear movement between the cleaning head and guide pin of 4 to 1. Therefore, the comparable ratio of distance between guide pin to pivot bearing 68 and cleaning head 36 to pivot bearing 68 will remain reasonably constant whether the telescoping tubes are extended or retracted. This assures greatest accuracy in positioning cleaning head 36 directly over a tube. At a ratio of 4 to 1, a locating error of 1/16" at the locating pin will result in a locating error at the cleaning head of ¼", which is quite acceptable. Under these conditions, if the cleaning head moves forward at 12 feet the pin will move back 3 feet which means there is a distance of 15 feet (plus the starting distance between the two). If the locating pin moved in the same direction as the cleaning head there would only be an additional 8 feet between the two. The added linear distance between the two increases the locating accuracy of the guide pin with respect to its pivotal component of movement.

Having described the various components making up overall tube cleaning apparatus 32 and the way in which these various components operate, the overall method of operation of the apparatus should be apparent. Referring to FIG. 3 in conjunction with FIGS. 1 and 2, it should be apparent that a given emission stack such as the one illustrated may be of sufficient size to require either more than one tube cleaning apparatus for a given plenum or the movement of the same apparatus to different points across the plenum. This is shown specifically in FIG. 3. Still another aspect of the present invention resides in the fact that tube cleaning apparatus 32 is readily adaptable to this particular situation. More specifically, the apparatus can be readily moved from, for example, the center location shown in FIG. 3 to one of the side locations. In a preferred embodiment, this is accomplished by removing the closure plate 72 along with the rest of the components making up the apparatus and moving it to a different opening 44. In this case, the original opening 44 would be closed with a solid closure plate (not shown).

Yet another aspect of the present invention and one which was eluded to above resides in the fact that all of the components making up the apparatus with the exception of support mechanism 46 and, of course, the cleaning head 36 and its associated air motor reside outside the rather hostile environment of emission stack 10. Since these latter components can be readily designed from an economical standpoint to withstand the hostile environment as described previously, the tube cleaning operation can be carried out during operation of the emission stack. In addition, the air motor itself can be eliminated by replacing the air hose with a drive cable and suitable motor means located outside the stack for rotating the cleaning head.

Figure 11:
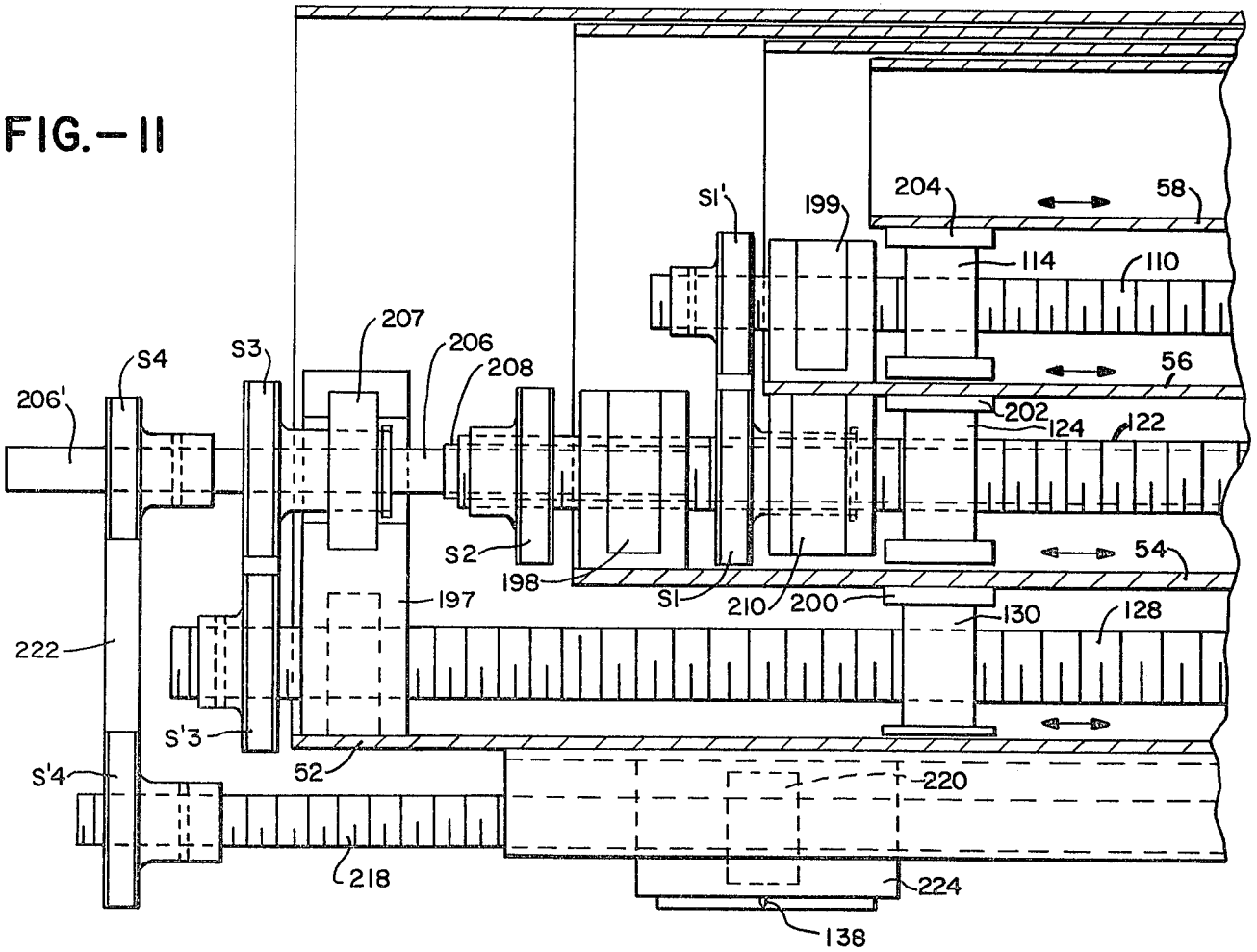
Figure 12:
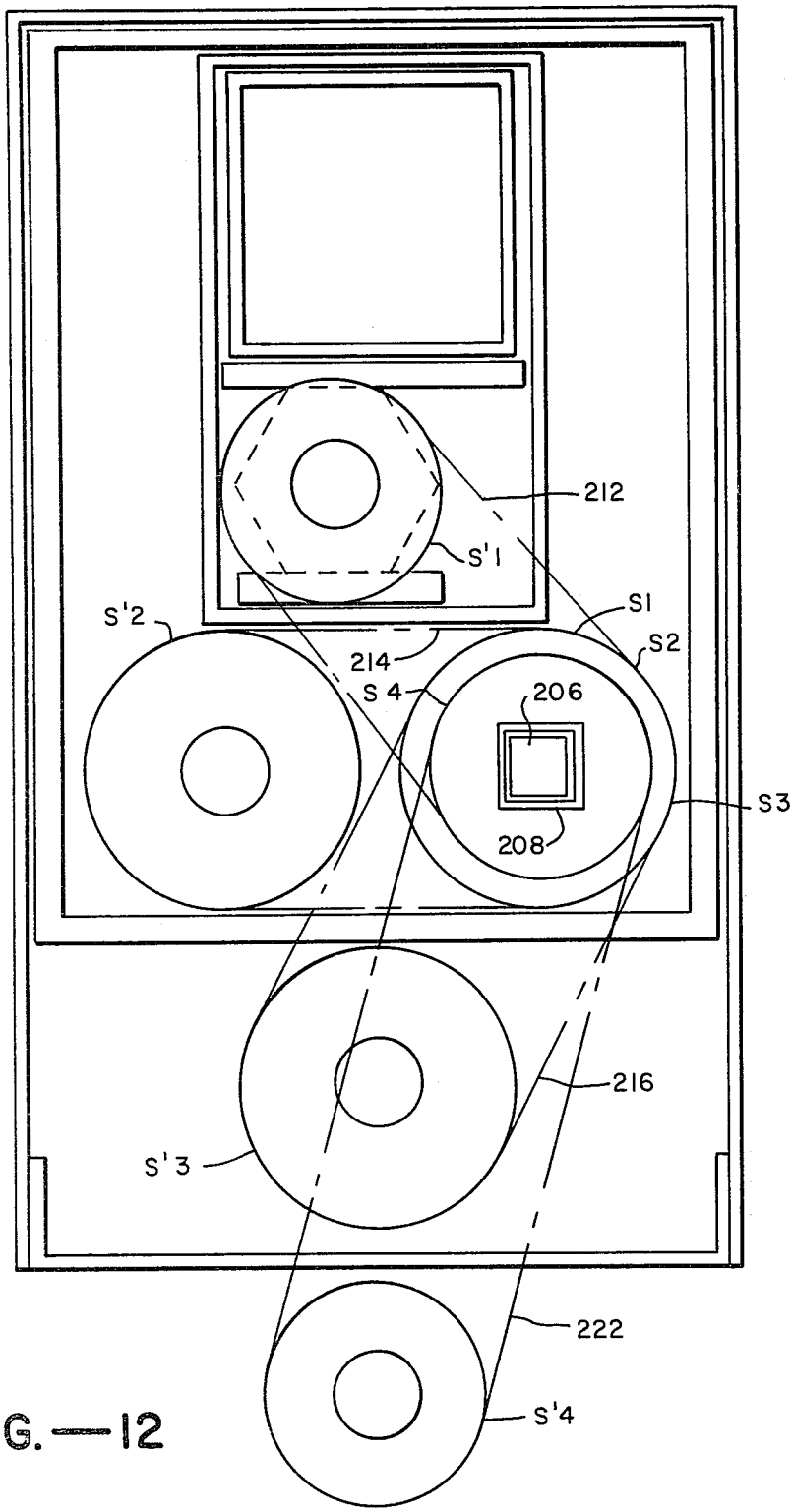

Turning now to FIGS. 11 and 12, attention is directed to a modified, preferred way in which the three tubes 54, 56 and 58 are simultaneously moved between their extended and retracted positions, as well as a modified and preferred way of simultaneously and correspondingly moving guide or locator pin 138. The rearwardmost ends of all three tubes 54, 56 and 58 are illustrated in FIG. 11 along with associated Acme rods 128, 122 and 110, respectively. Each rearwardmost end of each Acme rod is supported for rotation within and by suitable bearings 197, 198 and 199. Each previously described Acme nut 130, 124 and 114 is also shown along with an associated annular spacer 200, 202 and 204. These spacers may or may not be necessary (depending on the size of the Acme nuts) but, in any event, were not provided in the previously described embodiment. As illustrated in FIG. 11, the Acme nut 130 with associated spacer which travel along rod 128 and are connected with tube 54 for moving the latter. In a similar fashion, the Acme nuts 124 and 114 (and their spacers) which travel along respective rods 122 and 110 are connected to tubes 56 and 58 for moving these latter tubes. The forwardmost ends of the Acme rods are connected in the manner described previously.

As will be seen below, an overall arrangement of interconnected drive sprockets and a single drive shaft are provided for simultaneously rotating all three of the Acme rods so that the tubes 54, 56 and 58 move between their extended and retracted positions simultaneously. As will also be seen, the same drive shaft is used to simultaneously rotate an additional Acme rod but one having reverse threads for simultaneously moving locator pin 138 but in the opposite direction.

With specific reference to FIG. 11 in conjunction with FIG. 12, the drive shaft just mentioned is generally indicated at 206. As best seen in FIG. 12, this shaft is square in cross-section and is supported near its rearwardmost end by a suitable bearing 207. Its rearwardmost end generally indicated at 206 (FIG. 11) extends out beyond the rearward end of outermost housing or tube 52 and is adapted for connection to a suitable drive means, for example a variable speed, reversible drill or the like. As seen in FIG. 11, drive shaft 206 carries four drive sprockets for rotation therewith, specifically the drive sprockets S1, S2, S3 and S4. For reasons to be discussed below, the drive sprockets S1 and S2 are disposed on an outer drive shaft tube 208 which is disposed around shaft 206 for rotation therewith but which is readily slidable along the shaft. While not shown, the forwardmost end of drive shaft housing 208 is fixedly connected to tube 54 in the same manner as the forwardmost end of Acme rod 128 and thereby supports the forwardmost end of the shaft which is fixed longitudinally. In this way, outer housing 208 moves with tube 54. At the same time, for reasons to be discussed hereinafter, the drive sprocket S1 which moves longitudinally on and relative to housing 208 is mounted for rotation within a bearing 210 which also moves on and relative to the housing. This bearing is, in turn, fixedly connected to tube 56. On the other hand, the sprocket S2 is fixedly connected with the outer drive shaft tube 208 for longitudinal movement therewith.

In addition to the foregoing, as best illustrated in FIG. 12, each of the previously described drive sprockets S1, S2 and S3 include associated driven sprockets S1', S2' and S3'. Driven sprocket S1' is disposed around and fixedly connected to Acme rod 110, driven sprocket S2' is disposed around and connected to Acme rod 122 and driven sprocket S3' is disposed around and connected with rod 128. A roller chain 212 serves to interconnect the sprockets S1 and S1', a drive chain 214 serves to interconnect the sprockets S2 and S2' and a drive chain 216 serves to interconnect the sprockets S3 and S3'.

In actual operation, let is be assumed that all of the movable tubes 54, 56 and 58 are initially in their retracted positions, that is, the positions illustrated in FIG. 11. In these positions, the respective pairs of drive and driven sprockets are aligned with one another as shown. When the drive shaft 206 and housing 208 are rotated, all three of the drive sprockets S1, S2 and S3 rotate simultaneously, thereby causing their associated driven sprockets to rotate. The driven sprocket S3' causes the Acme rod 128 to rotate which, in turn, causes its associated nut 130 to move the tube 54 forward towards its extended position which, at the same time, causes the Acme rod 122 to move forward since the latter is connected at its forwardmost end to tube 54. Simultaneously therewith, rotation of sprocket S2' causes the Acme rod 122 to rotate which, in turn, causes its associated nut to move forward, thereby causing the tube 56 and the Acme rod 110 to move forward. Finally, the simultaneous rotation of driven sprocket S1' causes the Acme rod 110 to rotate, thereby causing its associated nut 114 and the innermost tube 58 to move forward. In addition to this interrelated movement of components, it should be pointed out that movement of the tube 54 in the forward direction causes the outer drive tube 208 to move the same distance and also causes the drive sprocket S2 and its associated bearing 198 to move the same distance. Moreover, since the bearing 210 and sprocket S1 are fixedly connected with tube 56, movement of these components are interrelated as they slide longitudinally on outer drive tube 208. This overall interrelationship of components as described above serves to maintain the sprockets S1 and S1' as well as S2 and S2' in alignment with one another during movement of the various tubes. This is not required for the sprockets S3 and S3' since the latter do not move longitudinally.

Having described the preferred way in which the tubes 54, 56 and 58 are simultaneously moved between their retracted and extended positions using a single drive means, attention is now directed to the way in which this same drive means causes previously described locator pin 138 to simultaneously move to a corresponding position on indexing plate 132. Referring specifically to FIG. 11, an additional Acme rod 218 is utilized to this end. Like the other Acme rods, this rod has its forwardmost end (not shown) supported for rotation on a fixed vertically extending support depending down from fixed housing 52. However, Acme rod 218 is different than the previous rods in that its threads are reversed. In this way, an associated Acme nut 220 which is disposed around the rod moves along the latter in the opposite direction as Acme nuts 114, 124 and 130 when rod 212 rotates in the same direction as the other rods.

In order to rotate 218 simultaneously with the other rods and in the same direction, a fourth drive sprocket S4 and an associated driven sprocket S4' are provided. Sprocket S4 is fixedly mounted for rotation on drive shaft 206 and driven sprocket S4' is fixedly mounted for rotation on Acme rod 218. A fourth roller chain 222 serves to interconnect these two sprockets. At the same time, Acme nut 220 is fixedly connected with and carries along a carriage or like support means 224 which, in turn, carries the indexing pin 138.

Operationally, as the drive shaft 206 is rotated for simultaneously moving the tubes 54, 56 and 58 in one direction, the drive shaft rotates rod 218 for moving Acme nut 220 and therefore indexing pin 138 in the opposite direction. If all of the Acme rods are rotated at the same speed and if threads are identical, although reversed, the ratio of movement between cleaning head 36 and indexing pin 138 is 3:1. However, the gearing between the various rods and the rods themselves could be readily designed to change this ratio.

What is claimed is:

1. A tube cleaning apparatus for use in an emission stack including a vertical housing containing a plurality of vertically extending emission tubes fixedly located adjacent one another and having opened top ends located below the top of said housing, said apparatus comprising:

a tube cleaning arrangement including head means for cleaning said tubes, one at a time;

a cleaning arrangement support assembly located partially within said stack housing above the top ends of said tubes and partially outside said housing through a cooperating opening in the latter, said support assembly including means located within said stack and supporting said head means for horizontal movement above said tubes, whereby to clean any given tube by first moving said head means directly above the given tube, drive means at least partially located outside said stack housing and connected with said support means for providing said horizontal movement from outside said housing, and means positioned outside said stack housing and connected with said support means for indicating the horizontal location of said head means relative to said tubes, whereby said indicating means serves as an indexing guide in locating said head means above any of said tubes.

2. An apparatus according to claim 1 wherein said cleaning arrangement support assembly includes means for substantially preventing any of the emission particles within said stack from escaping out of the latter through said assembly or said cooperating opening in said housing.

3. An apparatus according to claim 1 wherein said cooperating opening is sufficiently large to pass therethrough those components of said tube cleaning arrangement and support assembly located within said stack housing and wherein said assembly includes plate means sufficiently large to close said opening, said plate means supporting said head means supporting means, said drive means and at least a part of said indicating means.

4. An apparatus according to claim 1 wherein said tube cleaning arrangement includes means for moving said head means vertically between a raised position and a lowered position and wherein said head means mechanically cleans each of said tubes by passing into and through the latter.

5. An apparatus according to claim 4 wherein said tube cleaning arrangement moving means includes means located partially within and partially outside said housing and supporting said head means for said vertical movement and drive means outside said housing for providing said vertical movement.

6. An apparatus according to claim 1 wherein said means for supporting said head means for horizontal movement includes first means for moving said head linearly between a first retracted position and a second extended position and second means supporting said first means and said head means for pivotal movement about a predetermined vertical axis.

7. An apparatus according to claim 6 wherein said indicating means includes a horizontal plate fixedly mounted adjacent said vertical axis and having scaled down indicia representing the positions of said tubes, a guide pin, and means interconnected with said cleaning head means supporting means for horizontally moving said pin with said head across said indicia but in a scaled down way to indicate the location of said head means, said pin movement including a linear component in a direction opposite to the linear movement of said head means and a pivotal component about said vertical axis opposite to the pivotal movement of said head means.

8. An apparatus for cleaning a plurality of vertically extending tubes which are fixedly located adjacent one another and opened at their top ends, said apparatus comprising:

a tube cleaning arrangement including a mechanical cleaning head and means for moving said head vertically between a raised position and a lowered position; and a cleaning head support arrangement including means for moving said cleaning head horizontally to locations above said tubes when said head is in its raised position, whereby to clean any given tube by first moving said cleaning head to a point directly above said given tube and thereafter lowering said head into and through the latter, said support arrangement also including means positioned horizontally to one side of said tubes for indicating the horizontal location of said cleaning head relative to said tubes, whereby said indicating means serves as a guide in locating said cleaning head above any of said tubes.

9. An apparatus according to claim 8 wherein said cleaning head moving means includes first means for moving said head linearly between a first retracted position and a second extended position and second means for supporting said first means and said head for pivotal movement about a predetermined vertical axis.

10. An apparatus according to claim 9 wherein said first means includes a plurality of tubes interconnected for telescopic movement, said tubes including an innermost tube movable between said retracted and extended positions, and carrying said cleaning head for movement therewith, and an outermost tube linearly fixed but supported by said second means for pivotal movement about said vertical axis, whereby to pivotally move all of said tubes and said cleaning head about said axis.

11. An apparatus according to claim 10 wherein said first means includes individual means for linearly moving an associated tube except said outermost tube, each of said individual means including an Acme drive rod positioned adjacent and extending in the direction of its associated tube, means for supporting said rod for axial rotation only, and nut means mounted around said rod for movement along the latter during rotation of said rod, said nut means being fixedly connected with said associated tube for moving the latter therewith.

12. An apparatus according to claim 11 wherein said first means includes means for rotating said Acme rods simultaneously whereby to simultaneously move their associated tubes.

13. An apparatus according to claim 10 including means located between said tubes for reducing the flow of air therebetween and serving as bearing supports for the linear movement of the linearly movable tubes.

14. An apparatus according to claim 10 wherein said plurality of tubes includes at least three tubes, each of which includes a section in overlapped relationship with an adjacent tube when the tubes are in their extended positions, said innermost tube and its adjacent tube including the greatest lengthwise overlapping sections with the remaining overlapping sections getting smaller lengthwise from said greatest section to the overlapping section defined by said outermost tube and its adjacent tube.

15. An apparatus according to claim 9 wherein said indicating means includes a horizontal plate fixedly mounted adjacent said vertical axis and having scaled down indicia representing the positions of said tubes, a guide pin, and means interconnected with said cleaning head moving means for horizontally moving said pin with said head across said indicia but in a scaled down way to indicate the location of said head.

16. An apparatus according to claim 15 wherein the movement of said pin including a linear component in a direction opposite to the linear movement of said head and a pivotal component about said vertical axis opposite to the pivotal movement of said head.

17. A tube cleaning apparatus for use in an emission stack including a vertical housing containing a plurality of vertically extending tubes fixedly located adjacent one another and having opened top ends located below the top of said housing, said apparatus comprising:

(a) a tube cleaning arrangement including a mechanical cleaning head, first support means supporting said cleaning head for vertical movement between a raised position and a lowered position and second drive means for providing said vertical movement;

(b) a cleaning arrangement support assembly located partially within said stack housing above the top ends of said tubes and partially outside said housing, said assembly extending through a cooperating opening in the latter and including (i) cleaning head support means located within said stack and supporting said head for horizontal movement above said tubes when said head is in its raised position, whereby to clean any given tube by first moving said cleaning head to a point directly above said given tube and thereafter lowering said head into and through the latter, said cleaning head support means supporting said head for linear movement between a first retracted position and a second extended position and for pivotal movement about a predetermined vertical axis located in the plane of said cooperating opening through said housing, (ii) drive means connected with said cleaning head support means and partially located outside said stack housing for providing said horizontal movement from outside said housing, (iii) means positioned outside said stack housing and connected with said cleaning head support means for indicating the horizontal location of said cleaning head relative to said tubes, whereby said indicating means serves as an indexing guide in locating said cleaning head above said tubes, said indicating means including a horizontal plate fixedly mounted adjacent said vertical axis and having scaled down indicia representing the positions of the said tubes, a guide pin, and means interconnecting said pin with said cleaning head support means for horizontally moving said pin with said cleaning head across said indicia but in a scaled down way to indicate the location of said cleaning head, said pin movement including a linear component in a direction opposite the linear movement of said cleaning head and a pivotal component about said vertical axis opposite in direction to the pivotal movement of said cleaning head, and (iv) means for substantially preventing any of the emission particles within said stack from escaping out of the latter through said support assembly or said cooperating opening in said housing.

18. An apparatus according to claim 17 wherein said cleaning head support means includes a plurality of concentric telescopic tubes movable between extended and retracted positions for supporting said cleaning head for said horizontal movement and wherein said drive means includes means for simultaneously moving said tubes between their extended and retracted positions.

19. An apparatus according to claim 18 wherein said drive means includes an Acme rod means for moving each of said tubes and wherein said interconnecting means for moving said pin includes an Acme rod means, said means for simultaneously moving said tubes includes means for simultaneously rotating all of said Acme rod means including the lastmentioned one whereby to move said pin with the movement of said tubes.

* * * * *